US006446638B1

(12) United States Patent
Horman

(10) Patent No.: US 6,446,638 B1
(45) Date of Patent: Sep. 10, 2002

(54) HAIR CLIP FOR FINE HAIR

(75) Inventor: Heidi C. Horman, Mattapoisett, MA (US)

(73) Assignee: Remedies Trading Corporation, W. Wareham, MA (US)

( * ) Notice: Subject to any disclaimer, the term of this patent is extended or adjusted under 35 U.S.C. 154(b) by 0 days.

(21) Appl. No.: 09/716,733

(22) Filed: Nov. 20, 2000

Related U.S. Application Data

(60) Provisional application No. 60/168,945, filed on Dec. 3, 1999.

(51) Int. Cl.[7] ..... A45D 8/14

(52) U.S. Cl. ..... 132/275; 24/543; 24/30.5 S

(58) Field of Search ..... 132/207, 273, 132/275, 276, 278, 279; D28/39, 40, 41, 42, 43; 24/30.5 P, 30.5 S, 570, 545, 543; 63/43, 20, 29.1

(56) References Cited

U.S. PATENT DOCUMENTS

| | | | | | |
|---|---|---|---|---|---|
| 2,699,789 | A | * | 1/1955 | Goodman | 132/278 |
| 2,818,871 | A | | 1/1958 | Beaudry | |
| 3,192,932 | A | * | 7/1965 | Hart | 132/275 |
| 3,363,293 | A | * | 1/1968 | Nemrod et al. | 20/30.5 P |
| 3,375,765 | A | * | 4/1968 | Ichelson | 123/335 |
| 3,412,739 | A | | 11/1968 | Thatcher | |
| 3,735,765 | A | | 5/1973 | Ichelson | |
| 3,823,443 | A | | 7/1974 | Takabayashi | |
| 3,841,340 | A | | 10/1974 | Solomon | |
| D260,453 | S | | 9/1981 | Carlson | |
| 4,296,529 | A | | 10/1981 | Brown | |
| 4,425,926 | A | | 1/1984 | Rishton | |
| 4,551,888 | A | | 11/1985 | Beecher | |
| 4,753,252 | A | | 6/1988 | Boxer | |
| 4,834,730 | A | * | 5/1989 | Holtermann et al. | 604/335 |
| D301,548 | S | * | 6/1989 | Weaver | D9/499 |
| 4,896,685 | A | * | 1/1990 | Lawrence | 132/278 |
| D333,786 | S | * | 3/1993 | Carroll | D9/435 |
| 5,308,337 | A | * | 5/1994 | Bingisser | 604/174 |
| 5,318,054 | A | | 6/1994 | Neilson | |
| D367,744 | S | | 3/1996 | White | |
| 5,605,166 | A | | 2/1997 | Chou | |
| 5,638,836 | A | | 6/1997 | Yasuda | |
| 5,713,108 | A | * | 2/1998 | Solomon et al. | 24/30.5 R |

FOREIGN PATENT DOCUMENTS

| | | | | |
|---|---|---|---|---|
| FR | 618907 | | 3/1927 | |
| FR | 2239218 | | 2/1975 | |
| FR | 2523-421 | A | 3/1982 | |
| GB | 2 174 001 | A * | 10/1986 | A45D/8/24 |

* cited by examiner

*Primary Examiner*—Todd E. Manahan
*Assistant Examiner*—David Comstock
(74) *Attorney, Agent, or Firm*—John L. Lee

(57) ABSTRACT

A hair clip includes a formation defining an elongated base arm having two knobs, an elongated closure arm defining two apertures, and a hinge region connecting the arms for pivotal movement between open and closed positions. Each knob has a stem portion and a free end portion defining an end area with a peripheral acute angle flat-face detent. In a preferred embodiment, the hair clip, when closed, defines a passage for hair having several sharp bends, including acute angle 180° bends.

In a preferred embodiment, the passage passes between the inner face of the closure arm and the inner face of the base member at a first side of the hair clip, between a first interior side of the aperture and a first side of the stem, between the face of the detent and the outer face of the closure arm at the first side of the hair clip, over the free end portion of the knob, between the face of the detent and the outer face of the closure arm at a second side of the hair clip, between a second interior side of the aperture and a second side of the stem, and between the inner face of the closure arm and the inner face of the base member at the second side of the hair clip.

4 Claims, 3 Drawing Sheets

SECTION AA

SECTION BB

HAIR CLIP FOR FINE HAIR

This application claims priority to provisional application No. 60/168,945, filed Dec. 3, 1999.

TECHNICAL FIELD

This invention relates generally to hair accessories, and more particularly to a hair clip that securely grasps and holds in place the fine hair of an infant.

BACKGROUND

During the seventeen years that the inventor has been a hair stylist, she has received many complaints from her clients who have been unable to find a hair clip or barrette that will securely grasp and hold fine hair in place. Fine hair has a tendency to slip through the clamping arms. This is true for adults with fine hair, but more so for children's extremely fine hair.

SUMMARY OF INVENTION

A hair clip, according to the present invention includes a formation defining an elongated base arm, an elongated closure arm, and a hinge region connecting the arms for pivotal movement between an open position and a closed position. The closure arm has an inner face, and at least one elongated aperture with interior sides. The base arm includes a base member with an inner face, and at least one elongated knob projecting inwardly from the inner face, the at least one knob having a stem portion and a free end portion defining an end area.

The hair clip, when closed, defines a passage for hair having several sharp bends. The passage passes between the inner face of the closure arm and the inner face of the base member at a first side of the hair clip, between a first interior side of the aperture and a first side of the stem, over the free end portion of the knob, between a second interior side of the aperture and a second side of the stem, and between the inner face of the closure arm and the inner face of the base member at a second side of the hair clip.

In a preferred embodiment, the formation has two elongated apertures and two knobs. Each knob has a free end portion, wider than the stem portion, the free end portion defining an acute angle flat-face detent.

DETAILED DESCRIPTION

First Embodiment

Figure 1:
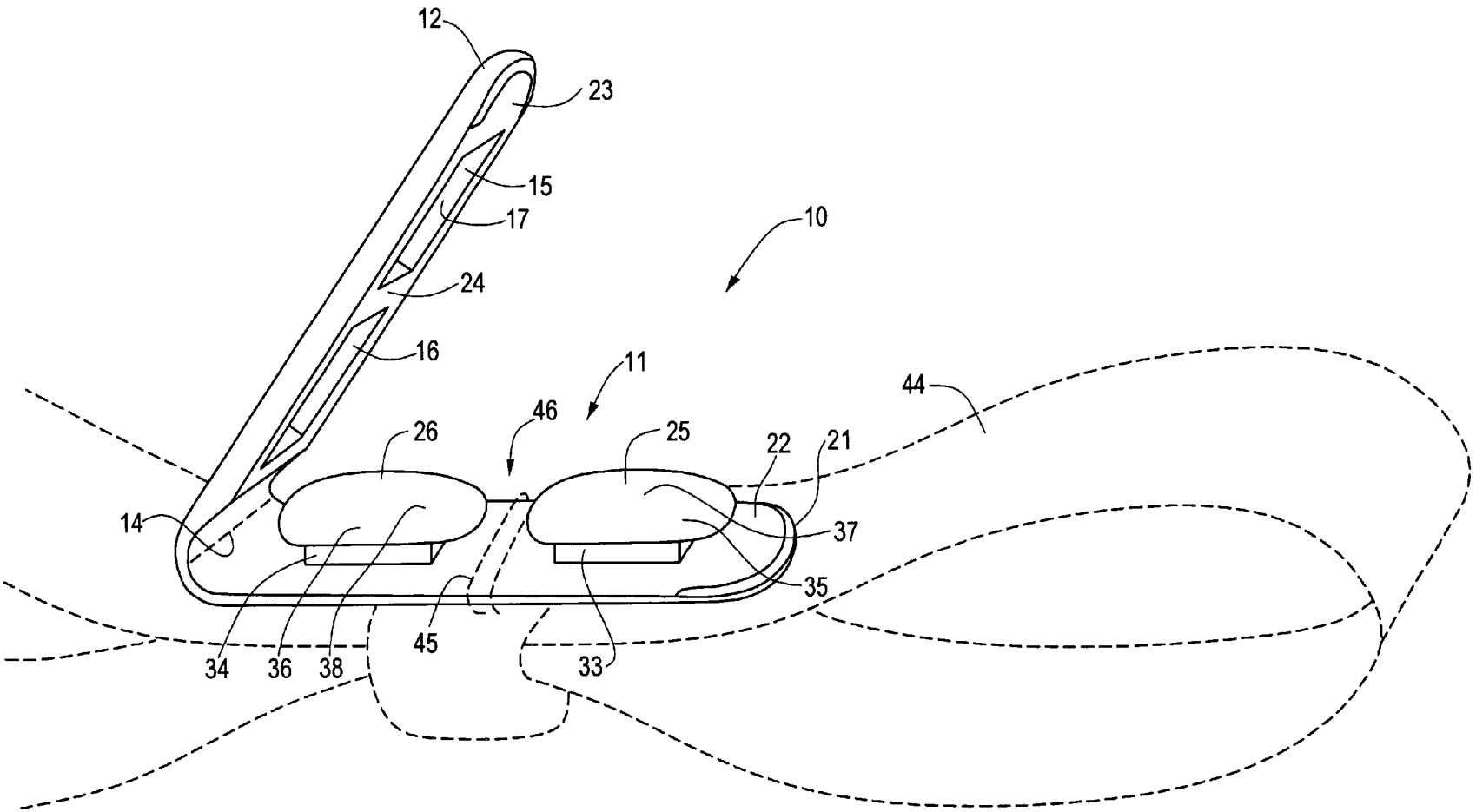
FIG. 1 is a perspective view of a first preferred embodiment of the invention showing the hair clip in the open position.
Figure 2:
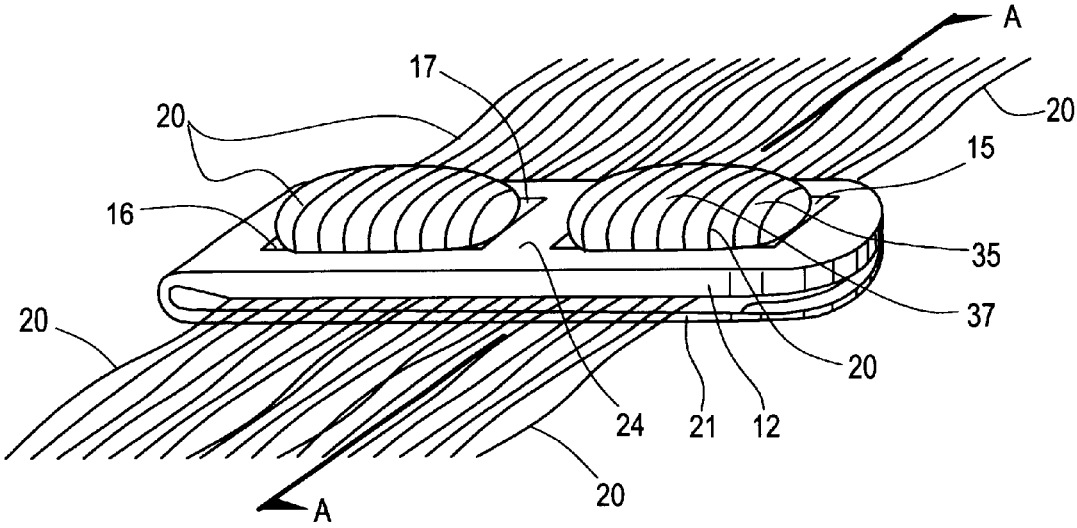
FIG. 2 is a perspective view of the embodiment of FIG. 1 in the closed position gripping a bunch of hair.

A first preferred embodiment of a hair clip according to the present invention is illustrated in FIGS. 1–5. FIG. 1 shows the first preferred embodiment in an open position. FIG. 2 shows the embodiment of FIG. 1 in the closed position gripping a bunch of hair 20.

Referring to FIGS. 1–4, hair clip 10 of the first preferred embodiment is a thermo-plastic elastomer formation defining elongated base arm. 11 and elongated closure arm 12, the two arms joined by hinge region 14. Hinge region 14 allows for pivotal movement of the arms between an open position and a closed position of the hair clip.

Base arm 11 includes base member 21, which defines inner face 22. First knob 25 extends inwardly from inner face 22. Second knob 26 also extends inwardly from inner face 22.

First knob 25 includes first stem 33, first free end portion 35, and cylindrical end area 37. Second knob 26 includes second stem 34, second free end portion 36, and cylindrical end area 38. In each case, the free end portion is wider than the corresponding stem portion.

Closure arm 12 defines first elongated aperture 15 and second elongated aperture 16 penetrating the closure arm over much of inner face 23. The elongated aperture has interior sides 17. See FIGS. 1 and 3.

FIG. 2 shows the embodiment of FIG. 1 in the closed position gripping a bunch of hair. FIG. 2 shows that when the hair clip is closed and holding hair 20, hair 20 passes over cylindrical end area 37.

Figure 3:
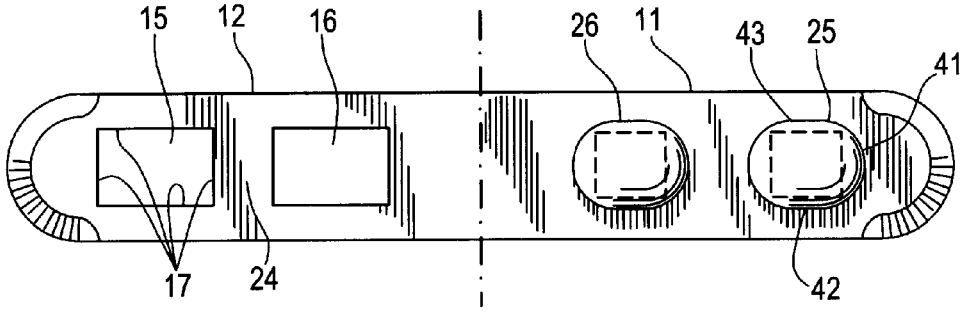
FIG. 3 is a top view of the embodiment of FIG. 1 in a stretched-out open position.
Figure 4:
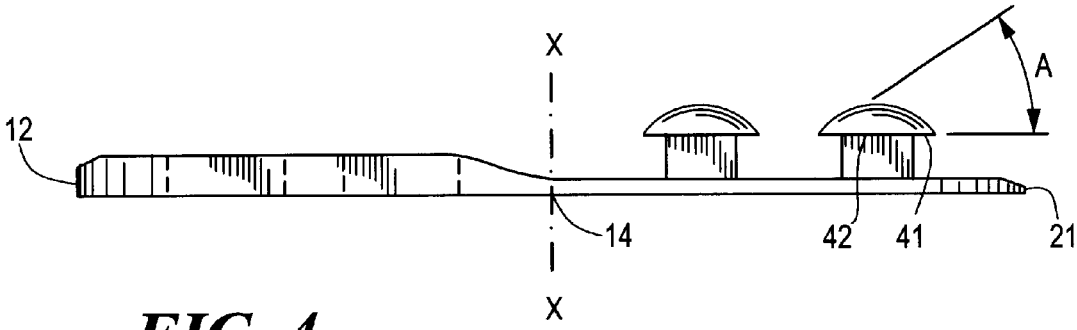
FIG. 4 is a side elevation view illustrating the hair clip of FIG. 1 in a stretched-out open position.

FIGS. 3 and 4 show a top view and a side elevation view, respectively of the embodiment of FIG. 1 in a stretched-out open position. FIG. 3 shows the interior sides 17 of the first elongated aperture. FIG. 4 shows an annular flat-face detent 41.

Figure 5:
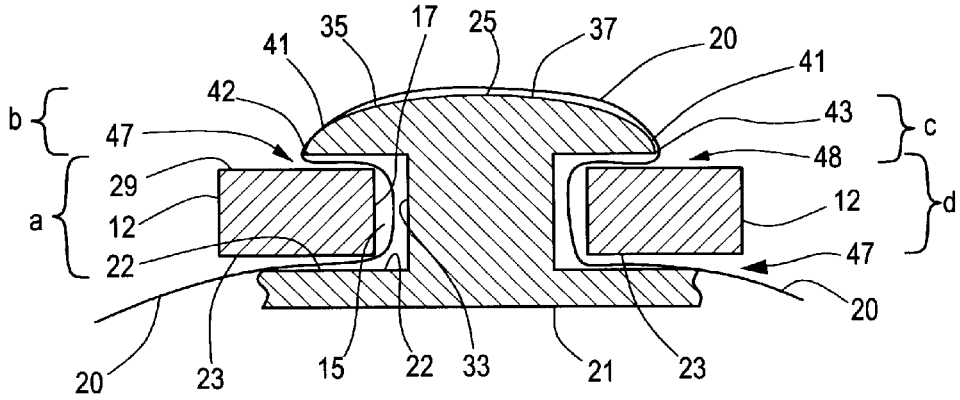
FIG. 5 is a cross-sectional view taken along line A—A of FIG. 2.

The embodiment of FIG. 1 is shown again in cross-section in FIG. 5. The cross-sectional view is taken along line A—A of FIG. 2. This view of the closed hair clip shows stem portion 33 in aperture 15, and free end portion 35 outside aperture 15. Strands of hair 20 pass between closure arm 12 and a first portion 42 of flat-face detent 41, pass over cylindrical end area 37, and also pass between closure arm 12 and an opposite second portion 43 of the flat-face annular detent 41. It can be seen from FIG. 4 that detent 41 has an acute angle section—angle "A".

First aperture 15 and first knob 25 define a passage for hair that has four 180° bends. The four bends are indicated in FIG. 5 as "a", "b", "c", and "d". Thus, the knob and the aperture cooperate to perform two functions: gripping the hair and holding the hair clip closed.

FIG. 5 shows a gap 47 between closure arm 12 and base member 22. It also shows a gap 48 between outer face 29 of closure arm 12 and first free end portion 35. However, in the preferred embodiment, the stem is sized so that there is substantially no gap when the hair clip is closed. These gaps are shown in FIG. 5 only to illustrate the path followed by the strands of hair.

It can be seen from FIG. 5 that the hair clip, when closed, defines a passage for hair. The passage passes between the inner face of the closure arm and the inner face of the base member at a first side of the hair clip (side a, b). It passes between a first interior side of the aperture and a first side of the stem. It passes between the face of the detent and the outer face of the closure arm at the first side of the hair clip. It passes over the free end portion of the knob, between the face of the detent and the outer face of the closure arm at a second side of the hair clip (side c, d). It passes between a second interior side of the aperture and a second side of the stem. It passes between the inner face of the closure arm and the inner face of the base member at the second side of the hair clip.

To provide sufficient rigidity in the closure arm, the thickness of the closure arm is greater than the thickness of the base member. Sufficient thickness is needed to maintain dimensional integrity of the apertures in the closure arm when the walls of the apertures are under pressure from the free end portion of the knobs. The relative thickness of closure arm 12 and base member 21 is best illustrated in FIG. 4. Also contributing to maintain dimension integrity of the apertures when the walls of the apertures are under pressure is bridge 24 shown in FIG. 2. FIG. 2 shows bridge 24 located between the first elongated aperture 15 and second elongated aperture 16 of closure arm 12.

Decoration is shown in FIG. 1 as bow 44, tied to base member 21 by a length of thread 45. Gap 46 between the two elongated knobs defines a portion of base member suitable for convenient central attachment of a bow. Bow 44 is tied by the length of thread 45 to base member 21. The thread passes through gap 46 and is located between the two stems. In particular, first stem 33 prevents the thread and the decoration from sliding off the hair clip.

To provide sufficient rigidity in the closure arm, the thickness of the closure arm is greater than the thickness of the base member. Sufficient thickness is needed to maintain dimensional integrity of the apertures in the closure arm when the walls of the apertures are under pressure from the free end portion of the knobs. The relative thickness of closure arm 12 and base member 21 is best illustrated in FIG. 4. Also contributing to maintain dimensional integrity of the apertures when the walls of the apertures are under pressure is bridge 24 shown in FIG. 2. FIG. 2 shows bridge 24 located between the first elongated aperture 15 and second elongated aperture 16 of closure arm 12.

The formation is preferably made of a thermoplastic elastomer ("TPE"), a rubber-like low-durometer thermoplastic material including a percentage of polypropylene and a percentage of elastomer. A suitable material is obtainable from M. A. Hanna Co., Cleveland, Ohio, USA. A relatively soft formulation is preferred for the infant's hair clip. A preferred formulation has approximately 30% elastomer for better grip.

Figure 7:
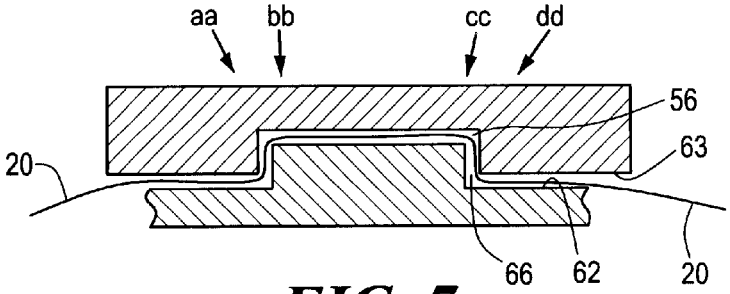
FIG. 7 is a cross-sectional view taken along line B—B of FIG. 6.
Figure 6:
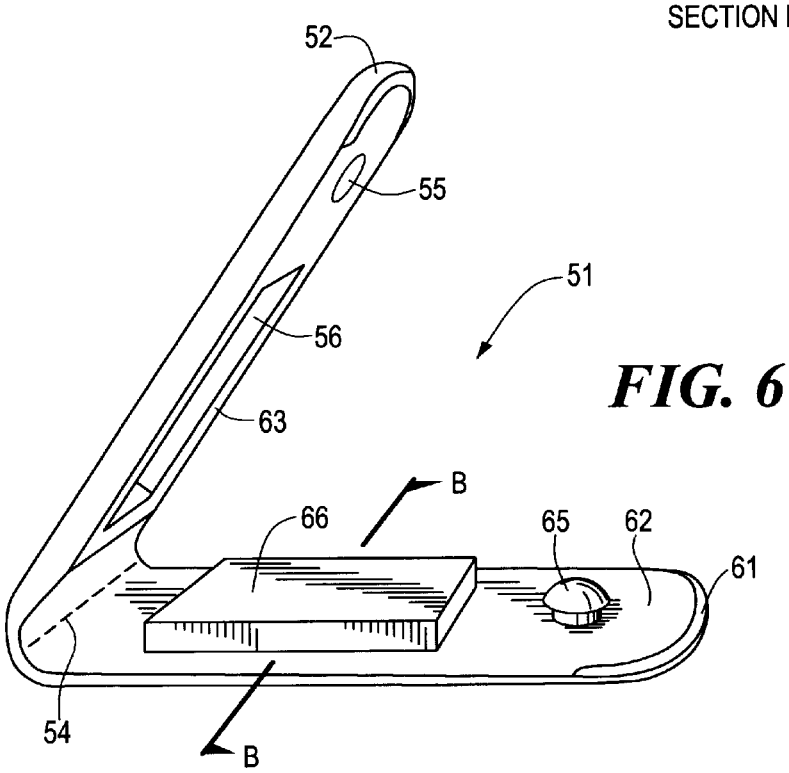
FIG. 6 is a perspective view of a second embodiment of the invention showing the hair clip in the open position.

A second embodiment of a hair clip according to the present invention is illustrated in FIGS. 6–7. FIG. 6 shows the second embodiment having a base arm 51 and an elongated closure arm 52, the two arms joined by hinge region 54.

Base arm 51 includes base member 61, which defines inner face 62. First knob 65 and second knob 66 extend inwardly from inner face 62. First knob 65 is a knob for locking the hair clip in the closed position. Second knob 66 is a substantially rectangular formation for clamping hair.

Closure arm 52 defines aperture 55, elongated recess 56 and inner face 63. The first knob engages the first aperture to lock the hair clip in the closed position. The second knob is sized to hold strands of hair firmly in recess 56.

Aperture 56, first knob 66 and inner faces 62 and 63 define a passage for hair that has four 90° bends. The four bends are indicated in FIG. 7 as "aa", "bb", "cc", and "dd".

What is claimed is:

1. A hair clip, comprising:

a formation defining an elongated base arm, an elongated closure arm, and a hinge region connecting the arms for pivotal movement between an open position and a closed position;

wherein the closure arm has an inner face and an outer face, and first and second elongated apertures each having interior sides;

wherein the base arm includes a base member with an inner face, and first and second elongated knobs, associated with first and second elongated apertures respectively, each knob projecting inwardly from the inner face, each knob having a stem portion and a free end portion defining an end area and a detent having a face; and wherein the first knob and the first aperture are adapted to perform two functions of gripping hair and holding the hair clip closed, and the second knob and the second aperture are adapted to perform the same two functions;

such that a given knob and associated given aperture when closed define a passage for hair, the passage passing between the inner face of the closure arm and the inner face of the base member at a first side of the hair clip, between a first interior side of the given aperture and a first side of the stem of the given knob, between the outer face of the closure arm and a first portion of the detent of the given knob, over the free end portion of given knob, between the outer face of the closure arm and a second portion of the detent, between a second interior side of the given aperture and a second side of the stem, and between the inner face of the closure arm and the inner face of the base member at a second side of the hair clip.

2. A hair clip according to claim 1, wherein the knob and the aperture define a passage for hair having four 180° bends, including two sharp 180° bends.

3. A hair clip according to claim 1, wherein the detent is annular.

4. A hair clip according to claim 1, wherein the first and second elongated apertures pass through the closure arm from inner face to outer face.

* * * * *